United States Patent [19]

Johnson et al.

[11] 4,449,100

[45] May 15, 1984

[54] IGNITION SYSTEM TESTER

[75] Inventors: Robert C. Johnson, Dearborn; Thomas C. Nation; David L. Perry, both of Canton, all of Mich.

[73] Assignee: Ford Motor Company, Dearborn, Mich.

[21] Appl. No.: 365,433

[22] Filed: Apr. 5, 1982

[51] Int. Cl.[3] ..... F02P 17/00

[52] U.S. Cl. ..... 324/378; 324/380; 324/388; 324/390; 324/399

[58] Field of Search ..... 324/388, 399, 378, 380, 324/390

[56] References Cited

U.S. PATENT DOCUMENTS 3,961,240 6/1976 Pohl ..... 324/399

FOREIGN PATENT DOCUMENTS 0020068 12/1980 European Pat. Off. ..... 324/380

0020069 12/1980 European Pat. Off. ..... 324/380

*Primary Examiner*—Stanley T. Krawczewicz

*Attorney, Agent, or Firm*—Peter Abolins; Robert D. Sanborn

[57] ABSTRACT

This specification discloses testing vehicle primary ignition systems by taking the integral of the primary spark plug firing voltage versus time over a time period when the spark should occur. To determine when an integration output should be evaluated, a phase locked loop circuit is used to predict the occurrence of an ignition firing pulse. To compensate for changes in engine speed and yet disregard extraneous spark plug firings, the phase locked loop circuit contains two loop filters having different response times which are automatically selected to minimize response to erroneous or missing spark plug firings and maximize response to actual engine RPM changes.

7 Claims, 7 Drawing Figures

TO CONTROL LOGIC
U6a
V REF
R112
R113
202
U4b
R111
R110
ENERGY THRESHOLD ADJ.
REFERENCE COMPARATOR

34
TO EXTRA PULSE LOGIC
ENERGY OUTPUT
16
R105
201
U4a
R108
CR116
VREF
C104
R115
R116
C105
R104
CR102
CR103
R107
R109
V+
CR104
R114
CR105
V BATT
R103
R106
TACH INPUT

DIFFERENTIAL INTEGRATOR & TACHOMETER SIGNAL CONDITIONING AND SHAPING

IGNITION SYSTEM TESTER

FIELD OF THE INVENTION

This invention relates to a device for determining the existence of faults in a vehicle ignition system.

PRIOR ART

Various apparatus and methods are known for testing vehicle ignition systems. For example, known methods have included examining the spark plug firing voltage pulse for a pulse peak, a zero crossing of voltage amplitude and a pulse time duration. Other known methods have included determining if a pulse occurred when it should occur and if a pulse occurred when it should not occur.

Some of these known ignition system testers are portable external units which are relatively difficult to hook-up for testing. Often it is necessary to establish a connection to the distributor and to all of the signal inputs to the vehicle ignition module which controls the firing of the spark plugs. Such signals typically include the control signal inputs to the ignition module and the power line inputs to the ignition module. The requirement for such connections produces a relatively expensive and complicated system. After these connections are made, the signals which are detected must be processed. Often such processing requires relatively expensive and complicated microprocessors. These are some of the problems this invention overcomes.

SUMMARY OF THE INVENTION

This invention recognizes that use of the time integral of the spark plug firing voltage pulse taken over a time period when spark should occur is useful in determining proper operation of a primary ignition system and the existence of faults in that system.

An ignition system tester in accordance with an embodiment of this invention can detect both intermittent and fixed faults present in the primary ignition system. It can be used during normal driving operation or in a service garage. It provides a relatively quick means of separating primary ignition system problems from fuel, carburetion, exhaust gas recirculation, or other system problems causing similar vehicle symptoms.

In accordance with an embodiment of this invention, a voltage related to the spark plug firing voltage pulse is measured and integrated over time to evaluate the magnetic flux in the primary ignition coil which ultimately generates the spark. This flux is related to the energy of the spark plug firing voltage pulse. Advantageously, in order to determine when an integration should be processed, a phase locked loop circuit is used to predict the occurrence of an ignition firing pulse. To compensate for changes in engine speed and yet disregard extraneous spark plug firings, the phase locked loop contains two loop filters, one of which is automatically selected to minimize response to erroneous firings and maximize response to actual engine RPM changes.

Figure 1:
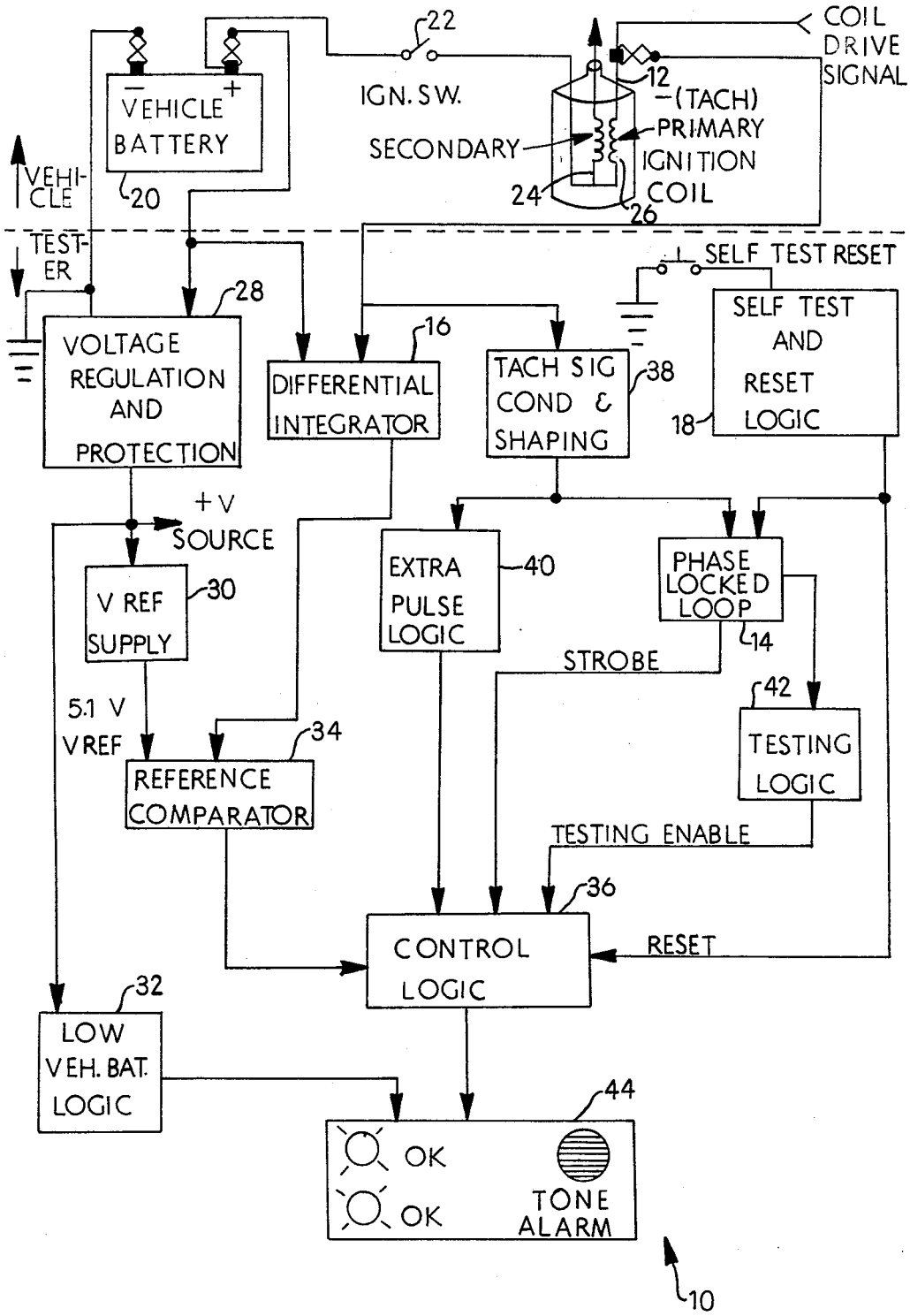
FIG. 1 is a block diagram of an ignition system tester in accordance with an embodiment of this invention including the connection of the phase locked loop and the differential integrator.

FIGS. *2a, 2b* and *2c* are a schematic diagram of the blocks of FIG. 1 entitled differential integrator and tachometer signal conditioning and shaping, reference comparator, and phase locked loop, respectively; and FIGS. *3a, 3b* and *3c* are graphical representations with respect to time of the primary coil voltage, the integral of the primary coil voltage and a comparator output comparing the integral of the primary voltage to a reference threshold, respectively.

DETAILED DESCRIPTION OF THE INVENTION

Referring to FIG. 1, an ignition system tester 10 monitors the primary ignition voltage waveform (at a coil tach terminal 12) and determines if a fault condition exists. A fault condition exists if (1) a preset number of consecutive tach pulses is missing, (2) a preset number of extra tach pulses occurs, or (3) a preset number of tach pulses exhibits energy below an acceptance threshold. When a fault is detected, a fault indicator can activate a light and sound an alarm. The fault indicator can remain activated until reset.

The test criteria applied to the primary ignition voltage waveform by the circuitry of tester 10 include two features in accordance with an embodiment of this invention. First, internal tester timing strobes allow determination of extra and missing tachometer pulses and are generated using a phase locked loop circuit 14 with automatically switchable loop filters. Second, an "energy" parameter is determined from the time integral of the difference between the primary voltage and the vehicle's battery voltage using a differential integrator 16.

In FIG. 1, a vehicle battery 20 has a positive terminal connected through ignition switch 22 to the primary side of an ignition coil 24. The negative terminal of vehicle battery 20 is grounded as is an input of the voltage regulation and protection circuit 28. Voltage regulation and protection circuit 28 also has an input from the positive terminal of vehicle battery 20. The output of regulation and protection circuit 28 is applied to a reference voltage supply 30 and to a low vehicle battery logic circuit 32. The output of reference voltage supply 30 is applied to a reference comparator 34. Differential integrator 16 has an input from the positive terminal of vehicle battery 20 and from the primary of the ignition coil 26. The output from differential integrator 16 is applied to reference comparator 34. The output of reference comparator 34 is applied to control logic 36. Voltage from the primary of the ignition coil 26 is also applied to a tachometer signal conditioning and shaping circuit 38. The outputs from circuit 38 are applied to an extra pulse logic circuit 40 and phase locked loop circuit 14. Phase locked loop 14 also receives an input from a self testing and reset logic circuit 18. An output from phase locked loop circuit 14 is applied to a testing logic circuit 42. The outputs from circuits 34, 40, 14, 42 and 18 are applied to control logic circuit 36. An output from control logic 36 and the low vehicle battery logic circuit 32 is applied to display unit 44.

The following discussion addresses the specific circuits implementing the features of the detection of erroneous tachometer pulses and the determination of the energy of the spark plug firing pulse. In an appendix the theory behind the "energy" parameter is discussed.

DIFFERENTIAL INTEGRATOR AND REFERENCE COMPARATOR CIRCUIT DESCRIPTION

Figures 2A, 2B:
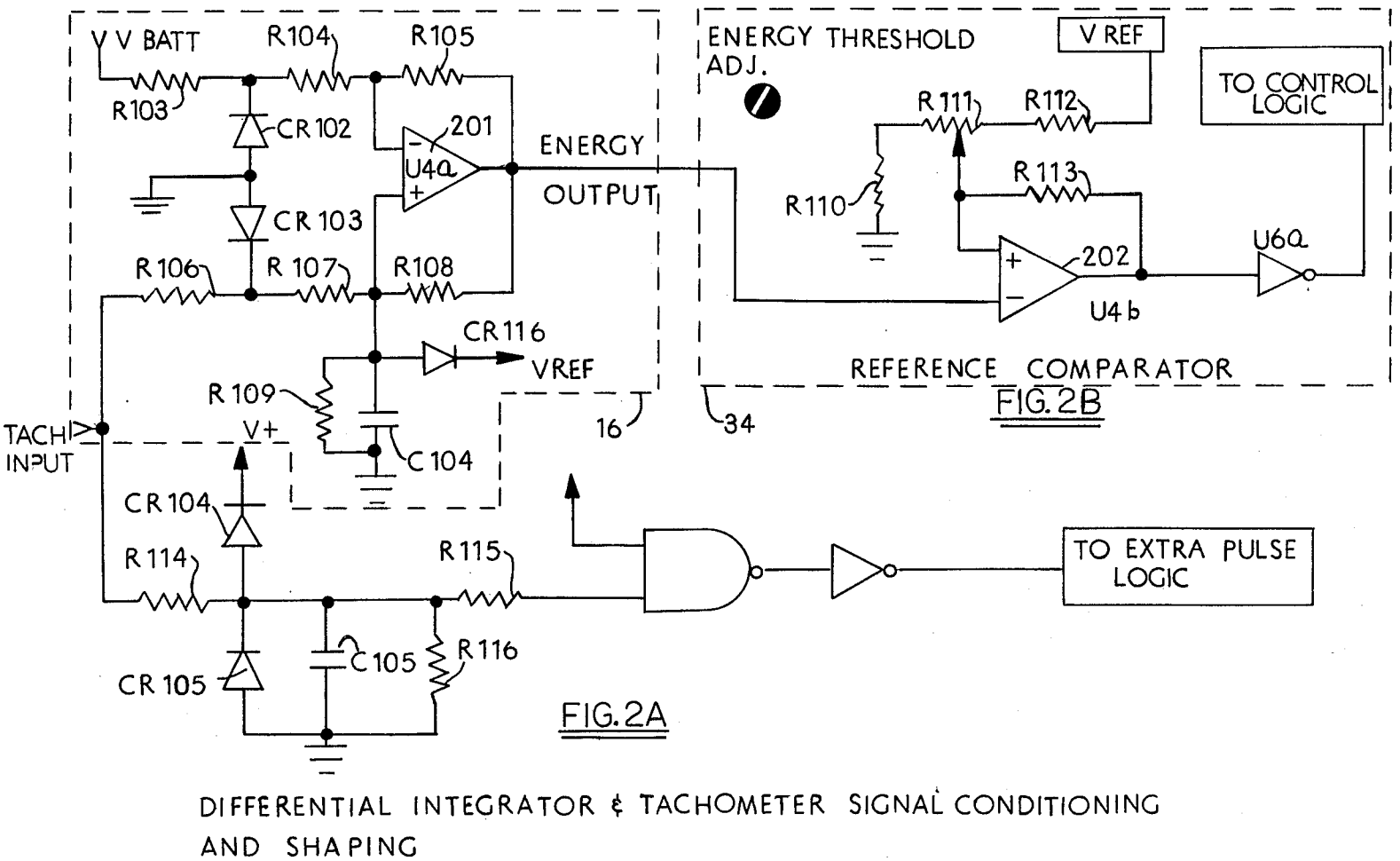

Referring to FIG. 2*a*, an input to differential inegrator block 16 is applied to the series combination of resistors R103, R104 and R105. Resistor R105 is connected as a feedback resistor from the output of an operational amplifier (op-amp) 201 to the inverting input of op-amp 201. A tachometer signal from the primary side of ignition coil 26 is applied to the series combination of resistors R106, R107 and R108. Resistor R108 is connected as a feedback resistor from the output of op-amp 201 to the non-inverting input of op-amp 201. An integrating capacitor C104 is connected from the non-inverting input of op-amp 201 to ground. A resistor R109 is connected in parallel with capacitor C104. Resistor R109 prevents capacitor C104 from charging due to operational amplifier offsets. Diode CR116 is connected between a reference voltage to the non-inverting input of op-amp 201 to limit this op-amp input voltage to the reference voltage. A diode CR103 is connected from between resistors R106 and R107 to ground. Similarly, a diode CR102 is connected from between resistors R103 and R104 to ground.

Differential integrator 16 provides the approximate $$\text{function } f(t) = \frac{1}{C104\,(R106 + R107)} \int (V_{tach} - V_{Bat})dt$$

The following assumptions are made:

(R103+R104)=(R106+R107)

(R105=R108)<<(R106+R107)

Op amp 201 input bias currents and offset voltage are zero

Diode reverse leakage currents are zero

The errors introduced into the function when the values of the above assumptions are included are negligible for integration intervals of less than ½ second. The integration function has endpoints at zero and at $V_{REF}$ plus one diode voltage drop. The zero endpoint is due to the unipolar supply voltage to operational amplifier 201. The $V_{REF}$ endpoint is due to diode CR116 clamping the voltage of capacitor C104 to $V_{REF}$. This is necessary to prevent a common-mode latch-up of operational amplifier 201.

The output of integrator 16 is supplied to a reference comparator 34 (FIG. 2*b*) which consists of comparator 202 and resistors R110, R111, R112 and R113. Reference comparator 34 as a whole determines if the ignition system has enough "energy" to reliably fire a spark plug, on a cycle by cycle basis. The inverting input of comparator 202 is coupled to the output of differential integrator 16. The non-inverting input of comparator 202 has an input through feedback resistor R113 from the output of comparator 202 and a variable resistance R111 coupled between a reference supply voltage and ground. The adjustment of variable resistance R111 determines the threshold which, when exceeded, initiates the change of state of the comparator output, as shown in FIG. 3*c*. When the integral shown in FIG. 3*b* exceeds the threshold there is an output from comparator 202 indicating that the "energy" is sufficient. The output of comparator 202 goes to a logic low level if the output of differential integrator 16 reaches the reference threshold.

PHASE LOCKED LOOP CIRCUIT DESCRIPTION

Figure 2C:
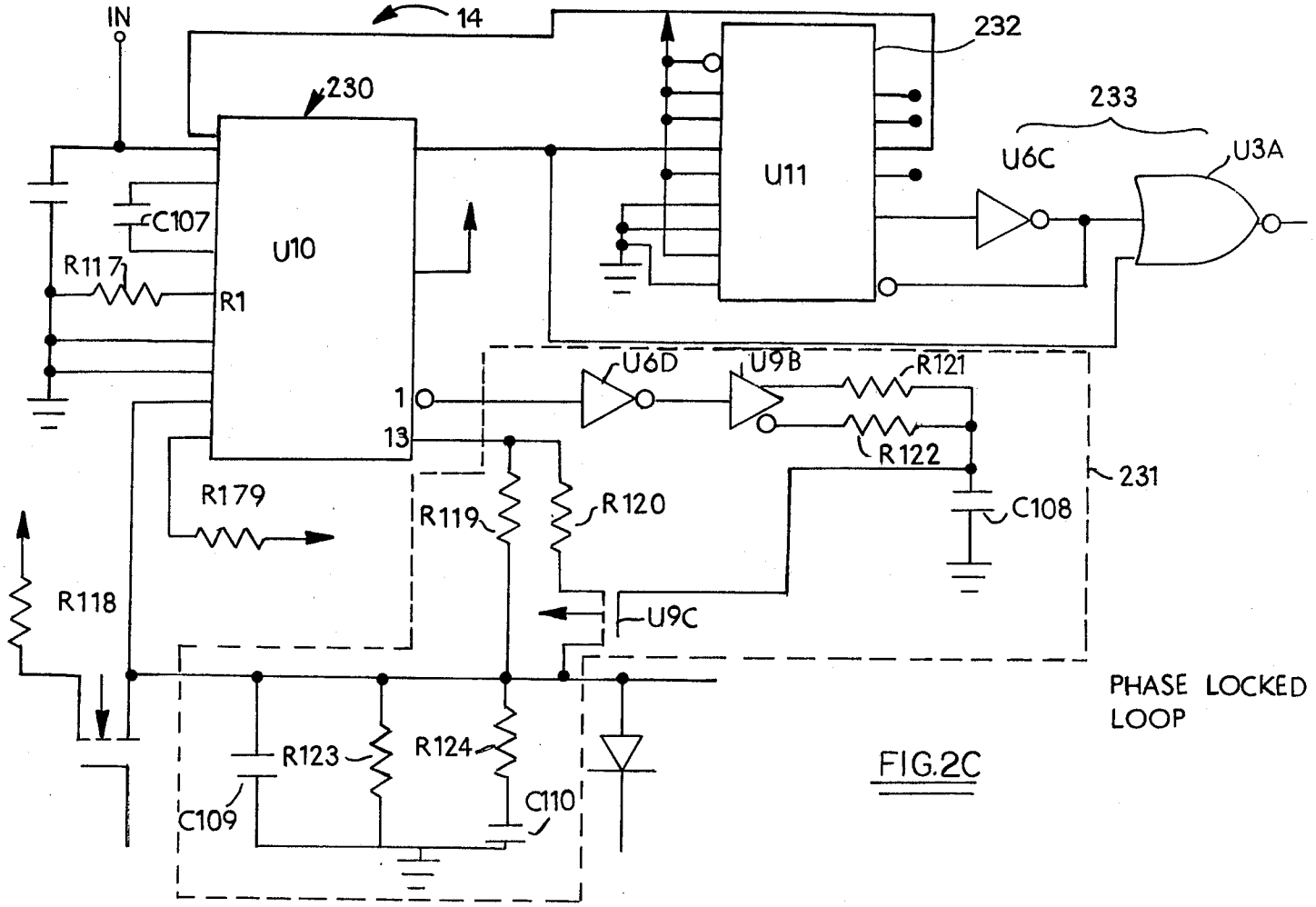

Referring to FIG. 2*c*, phase locked loop (PLL) circuit 14 includes circuitry to produce a strobe output. The strobe pulses are used to reset and clock portions of the control logic at precise times. Strobe pulses occur coincident with actual tachometer pulses or at a time when tachometer pulses should have been present and are missing due to an ignition system problem. In essence, PLL circuit 14 keeps track of tachometer pulses, by generating a strobe pulse each time that a tachometer pulse occurred or should have occurred, and thereby detects a tachometer signal which has spurious transitions, oscillations, or stops abruptly due to a failure of the primary ignition signal.

Inputs to the phase locked loop circuit 14 are: (1) the filtered and limited TACH signal output of FIG. 2A and (2) a signal from a test and reset logic 18 which forces a self-test. Outputs from PLL circuit 14 are a timing strobe signal and a D.C. level which enables the testing logic.

Referring to FIG. 2*c*, PLL circuit 14 can be broken down into several components: A phase locked loop (PLL) integrated circuit 230, an external dual loop filter 231, a loop frequency multiplier 232 and a strobe logic circuit 233. Resistor R117 and capacitor C107 associated with integrated circuit 230 provide a frequency lock range of two hertz to five hundred hertz, or 30 RPM to 7500 RPM of engine speed for an eight cylinder engine. Loop filter 231 is a variable rate, multiple pole low pass filter. The basic nonvariable filter consists of resistors R119, R123 and R124 and capacitors C109 and C110. This filter is in operation during steady state frequency inputs, or slowly varying-frequency inputs.

To provide proper timing during fast frequency changes such as acceleration, an electrically variable resistance is supplied in parallel with resistor R119. Resistor R120 and a MOS transistor U9c form the electrically variable resistor. The gate voltage is generated by inverters U6d and U9b, resistors R121 and R122, and capacitor C108. The input to this circuit at inverter U6d is from a lock signal at pin 1 of PLL integrated circuit 230. This lock signal, when low, indicates that PLL integrated circuit 230 is not phase locked with the PLL circuit 14 input signal. This occurrence causes the voltage on the gate of MOS transistor U9c in the loop filter to be reduced, effectively reducing the transistor's channel resistance. This reduced resistance shunts resistor R119 and speeds up the PLL integrated circuit 230 tracking response. Once PLL integrated circuit 230 regains lock, transistor U9c again turns off, restoring the normal filter. That is, resistor R120 is excluded from the functioning of the filter. Resistor R179 is coupled to PPL integrated circuit 230 and can provide PLL frequency offset from zero to further stabilize the circuit during rapid acceleration or deceleration.

The loop frequency multiplier 232, including an integrated circuit U11, forces PLL circuit 14 to operate at seven times the input frequency and sets the timing strobe very near the midpoint between rising edges of the TACH waveform, as well as allowing for smaller valued capacitors for the PLL and the loop filter. Logic gates U6c and U3a form strobe logic circuit 233 which provides a very narrow strobe pulse for the control logic block.

Figure 3A:
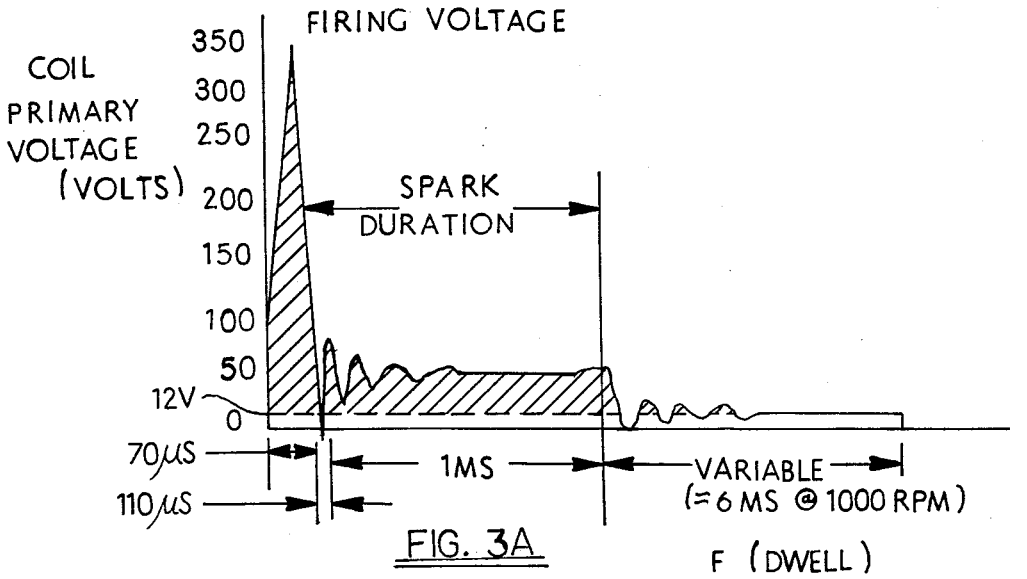
Figure 3B:
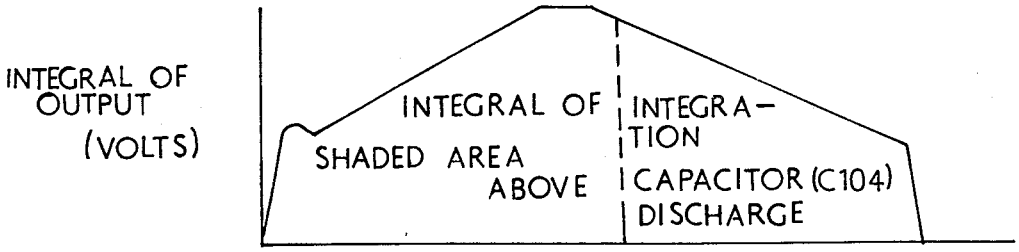
Figure 3C:
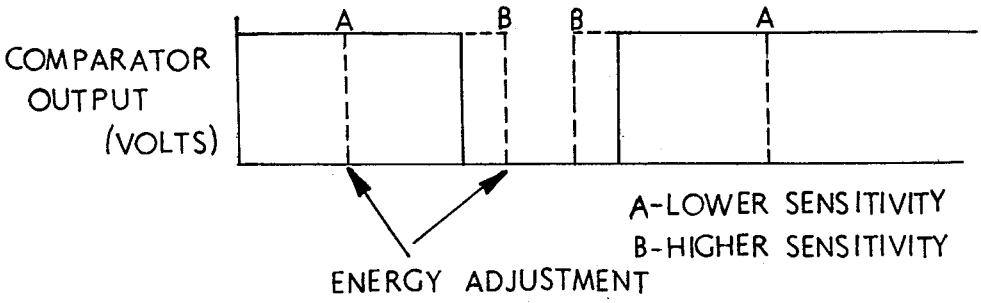

Referring to FIG. 3*a*, a graphical representation of the primary coil voltage versus time indicates that a firing voltage peak occurs before a series of oscillatory voltage fluctuations. The shaded area above vehicle battery voltage (12 volts) is the portion that is integrated. FIG. 3*b* shows the integral of the shaded portion of FIG. 3*a*. That is, this is the operation performed by differential integrator 16 of FIGS. 1 and 2*b*. The rapid firing voltage (first spike of FIG. 3*a*) is indicated by a rapid rise in the integral of FIG. 3*b*. The subsequent smaller oscillations and voltage level of FIG. 3*a* are indicated by a gradual increase in the total integral. The integral is computed during a predetermined spark duration. At the end of the computation, a determination is made whether the integral has reached an acceptable, pre-set threshold or not. If the pre-set acceptable threshold has been reached, the available spark "energy" is assumed to be sufficient. This comparison is made in reference comparator 34, the output of which is illustrated in FIG. 3*c*. That is, the comparator output remains high until the threshold is reached whereupon it drops. The indication of a capital A (low sensitivity) and capital B (higher sensitivity) reflects the possibility of adjusting the threshold as indicated in FIG. 2*b* in connection with variable resistor R111.

Various modifications and variations will no doubt occur to those skilled in the various arts to which this invention pertains. For example, the particular choice of circuit components may be varied from that disclosed herein. These and all other variations which basically rely on the teachings through which this disclosure has advanced the art are properly considered within the scope of this invention.

APPENDIX

ENERGY PARAMETER THEORY

The tester derives "energy" data about the primary ignition system by integrating the ignition coil primary (TACH) voltage greater than the vehicle battery voltage for each ignition pulse. The output of the differential integration, as a function of time, is equal to $(1/CR)\int(V_{tach}-V_{bat})\,dt$, where (1/CR) is the gain of the integrator, $V_{tach}$ is the coil primary voltage, and $V_{bat}$ is the vehicle battery voltage.

The integrator output has the units of volt-seconds. Since volt-seconds are the units for a Weber, the integrator output is a measure of primary coil magnetic flux $\phi$. Flux of the primary coil is related to the flux of the secondary in the coil by the coupling coefficient, k.

$k=(\phi 2/\phi 1)$ where, $\phi 2$ is the flux of the secondary and $\phi_1$ is the flux of the primary. Flux can be related back to energy in the following manner:

Maxwell's equation (in integral form) for current, I, is:

$$I=\int \overline{H}\cdot\overline{dL} \text{ (Ampere's law)}$$

This equation, in essense, states that in an inductor, the magnetic field intensity, H, multiplied by the magnetic path length is equal to the current, I. Stated differently, the current in a coil of wires produces a certain magnetic field intensity, H. The magnetic field intensity, H, can be related to the flux density, B and the permeability, $\mu$, of the inductor core material by $B=\mu H$. Flux density, B, is flux per area or Webers/(Meter$^2$) and H is $$\frac{(\text{Amp})\cdot(\text{Turns})}{\text{Meter}}.$$

Also, $\phi=BA$, where A=magnetic cross-sectional area. Energy density is $W_v=\frac{1}{2}\mu H^2$ or $$W_v=\tfrac{1}{2}\mu H\frac{B}{\mu}=\tfrac{1}{2}BH=\tfrac{1}{2}\left(\frac{\phi}{A}\right)H.$$

From this result, magnetic flux has a direct relationship to the energy density, $W_v$. To obtain the actual value for energy, W, multiply Wv by the volume of the magnetic material.

$$W_v=\tfrac{1}{2}\frac{(Wb)}{(M^2)}\;\frac{(I\cdot\text{turns})(M^3)}{M},\quad W=\tfrac{1}{2}(Wb)(I\cdot\text{turns}) \tag{1}$$

Or $$W=\tfrac{1}{2}\phi IN$$

wherein N is the number of turns of wire in the inductor. By substituting $L=(N\phi/I)$ into equation (1), the standard form of magnetic energy stored in an inductor is obtained. That is:

$W_{mag}=\frac{1}{2}LI^2$, where L is inductance. To further prove that the integrator output is a measure of magnetic flux, the integrator output voltage can be related to the induced primary and secondary voltages and currents of the ignition coil by the equation for mutual inductance.

$$M=\frac{V_1}{\left(\frac{dI_2}{dt}\right)}=\frac{V_2}{\left(\frac{dI_1}{dt}\right)}$$

where:

subscript 1=primary
subscript2=secondary
V=voltage
I=current solving for $V_1$, $$V_1=V_2\frac{\left(\frac{dI_2}{dt}\right)}{\left(\frac{dI_1}{dt}\right)} \tag{2}$$

$$\frac{\left(\frac{dI_2}{dt}\right)}{\left(\frac{dI_1}{dt}\right)}$$

is simply a ratio of the rate of change of secondary current to the rate of change of primary current. For a given ignition coil design, this ratio is constant and is directly related to the flux, $\phi$. Since it is the primary current, I, which produces the secondary flux, $\phi_2$, and secondary current, $I_2$, which produces $\phi_1$, (according to Faraday's Law and Lenz's law) equation (2) can be rewritten as:

$$V_1 - V_2\left(\frac{\phi_1}{\phi_2}\right)$$

the ratio $\frac{\phi_1}{\phi_2} = \frac{1}{k}$, therefore, $V_1 = \frac{1}{k} V_2$ Integrating both sides, $$\int V_1\,dt = \frac{1}{k}\int V_2\,dt \text{ or } V_{1t} = \frac{1}{k} V_{2t}, \quad (3)$$

Note: $V_1 = (V_{tach} - V_{bat})$ and gain, $\frac{1}{CR} = 1$ but $V_1t$ has the units of volt-seconds.

Equation (3) now becomes $$\phi_1 = \frac{1}{k}\phi_2 \text{ or } k = \frac{\phi_2}{\phi_1}$$

which is again, the definition of the coupling coefficient, k for a transformer, such as an ignition coil.

This verifies that the integrator output is actually a measure of the primary magnetic flux which has been directly related to the stored energy of the ignition coil. By measuring this primary flux and comparing its value to an established reference (acceptance), a decision can be made as to the integrity of each individual spark cycle in the vehicle ignition system.

We claim:

1. A vehicle ignition system tester for determining when a fault exists in the ignition system of a vehicle, said ignition system tester including:

detection means for detecting the occurrence of a spark firing voltage;

integrating means for integrating the spark firing voltage over a predetermined period of time; and decision means for determining whether the integrated voltage reaches a predetermined threshold thus signifying that sufficient spark plug firing energy was stored in the coil and there is no fault in the vehicle ignition system, said decision means including:

a phase lock loop circuit for generating strobe pulses at predicted spark plug firing times and comparing the occurrence of a spark plug firing pulse to the occurrence of the strobe pulse;

a first phase lock loop filter having a relatively slow time constant for adjusting the strobe repetition rate to slow changes in engine speed;

a second phase lock loop filter having a relatively fast time constant for adjusting the strobe repetition rate to rapid changes in engine speed; and a selection means for selecting between said first and second phase lock loop filters so as to minimize strobe repetition rate change in response to additional erroneous or missing spark plug firing pulses and maximize strobe repetition rate change in response to actual changes in engine speed.

2. A vehicle ignition system tester as recited in claim 1 wherein said integrating means includes:

a first operational amplifier means to provide a means for integrating the primary coil voltage when it exceeds a vehicle battery voltage for a predetermined amount of time; and a second operational amplifier means connected as a comparator for comparing the integrated voltage to a predetermined threshold to determine if sufficient spark energy is available for spark firing.

3. A vehicle ignition system as recited in claim 2 wherein said first operational amplifier means includes:

an integrating capacitor coupled between a non-inverting input of said first operational amplifier means and ground.

4. An ignition system tester to test an ignition system having primary and secondary windings for proper operation including:

a phase-locked-loop circuit to track engine RPM and to generate internal strobe pulse timing at predicted spark plug firing times and comparing the occurence of a spark plug firing pulse to the occurence of the strobe pulse;

a first phase lock loop filter having a first resistor capacitor time constant, said first time constant being relatively slow for adjusting the strobe repetition rate to slow changes in engine speed;

a second phase lock loop filter having a second resistor capacitor time constant, said second time constant being relatively fast for adjusting the strobe repetition rate to rapid changes in engine speed; and a selection means for selecting between said first and second phase lock loop filters so as to minimize strobe repetition rate change in response to additional erroneous or missing spark plug firing pulses and maximize strobe repetition rate change in response to actual changes in engine speed, said selection means including a transistor means coupled to control current flow through said second phase lock loop filter and having a control electrode responsive to differences between the strobe repetition rate of said phase lock loop circuit and the repetition rate of actual spark plug firing of the vehicle ignition system.

5. An ignition system tester as recited in claim 4 wherein:

said first phase lock loop filter includes the series combination of a first resistor and a capacitor;

said second phase lock loop filter includes a second resistor in parallel with said first resistor; and said selection means includes a MOS transistor in series with said second resistor to selectively couple said first and second resistors in parallel thereby reducing the resistance coupled in series with said capacitor and changing the charging time of the capacitor.

6. An ignition system tester as recited in claims 4 or 5 further comprising:

integrating means for generating the time integral of the primary induced voltage above the vehicle battery voltage of each ignition firing.

7. An ignition system tester as recited in claim 6 wherein said integrating means includes:

a first operational amplifier means to provide a means for integrating the difference between the primary coil voltage and the vehicle battery voltage for a predetermined amount of time; and a second operational amplifier means connected as a comparator for comparing the integrated voltage to a predetermined threshold to determine if sufficient spark energy is available for spark firing.

* * * * *